US006791590B2

(12) United States Patent
Misaizu et al.

(10) Patent No.: US 6,791,590 B2
(45) Date of Patent: Sep. 14, 2004

(54) IMAGE FORMATION METHOD AND APPARATUS

(75) Inventors: Toru Misaizu, Ebina (JP); Kunio Yamada, Ebina (JP); Takashi Yamamuro, Ebina (JP); Makoto Hirota, Ebina (JP); Akira Ishii, Ashigarakami-gun (JP); Yasuki Yamauchi, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/383,539

(22) Filed: Mar. 10, 2003

(65) Prior Publication Data

US 2004/0080602 A1 Apr. 29, 2004

(30) Foreign Application Priority Data

Oct. 29, 2002 (JP) ..... 2002-314721

(51) Int. Cl.[7] ..... B41J 2/36; G03G 15/01; G03G 13/01

(52) U.S. Cl. ..... 347/115; 347/188; 347/129; 399/58

(58) Field of Search ..... 347/115, 129, 347/188; 399/48, 53, 58, 222

(56) References Cited

U.S. PATENT DOCUMENTS 4,459,344 A * 7/1984 Jacob ..... 430/97
4,871,408 A * 10/1989 Honma et al. ..... 156/83
5,122,430 A * 6/1992 Nishitsuji et al. ..... 430/108.6
5,122,813 A * 6/1992 Lass et al. ..... 347/225
5,563,694 A * 10/1996 Katayama ..... 399/2
5,985,501 A * 11/1999 Sato et al. ..... 430/111.41
6,165,667 A * 12/2000 Takagi et al. ..... 430/110.2
6,708,012 B2 * 3/2004 Misaizu et al. ..... 399/130
2004/0032601 A1 * 2/2004 Ishii et al. ..... 358/1.9
2004/0036896 A1 * 2/2004 Yamauchi et al. ..... 358/1.9
2004/0036897 A1 * 2/2004 Yamauchi ..... 358/1.9
2004/0036922 A1 * 2/2004 Yamada et al. ..... 358/3.21
2004/0037573 A1 * 2/2004 Hirota et al. ..... 399/12
2004/0037578 A1 * 2/2004 Kurita et al. ..... 399/67
2004/0037583 A1 * 2/2004 Machida ..... 399/100
2004/0037589 A1 * 2/2004 Yamauchi et al. ..... 399/130

FOREIGN PATENT DOCUMENTS

| | | |
|---|---|---|
| JP | 52-28325 | 3/1977 |
| JP | A 7-61047 | 3/1995 |
| JP | A 2000-131875 | 5/2000 |
| JP | A 2001-134006 | 5/2001 |
| JP | A 2001-194846 | 7/2001 |
| JP | A 2002-244384 | 8/2002 |

* cited by examiner

*Primary Examiner*—Daniel J. Colilla
*Assistant Examiner*—Leo T. Hinze
(74) *Attorney, Agent, or Firm*—Oliff & Berridge, PLC

(57) ABSTRACT

An image formation method for forming an image containing an embossed portion of an expandable material on a recording medium, comprising converting height information about an embossed image which is the image of the embossed portion to the same density information as one used to indicate a density of a non-embossed image which is not raised, and controlling an amount of the expandable material formed on the recording medium according to the converted density information.

17 Claims, 5 Drawing Sheets

TABLE 1

| HEIGHT RATIO T% (%) | THERMAL EXPANDABLE TONER AMOUNT H | THERMAL EXPANDABLE TONER DENSITY H% (%) |
|---|---|---|
| 0 | H0 | 0 |
| ⋮ | ⋮ | ⋮ |
| 40 | ⋮ | ⋮ |
| ⋮ | ⋮ | ⋮ |
| 50 | ⋮ | ⋮ |
| ⋮ | ⋮ | ⋮ |
| 70 | H30 | 30 |
| ⋮ | ⋮ | ⋮ |
| 100 | Hm | 100 |

FIG.3A

TABLE 1'

| HEIGHT RATIO T% (%) | THERMAL EXPANDABLE TONER AMOUNT H | THERMAL EXPANDABLE TONER DENSITY H% (%) |
|---|---|---|
| 0 | H0 | 0 |
| ⋮ | ⋮ | ⋮ |
| 40 | ⋮ | ⋮ |
| ⋮ | ⋮ | ⋮ |
| 50 | H50 | 50 |
| ⋮ | ⋮ | ⋮ |
| 70 | ⋮ | ⋮ |
| ⋮ | ⋮ | ⋮ |
| 100 | Hm | 100 |

FIG.3B

TABLE 1"

| HEIGHT RATIO T% (%) | THERMAL EXPANDABLE TONER AMOUNT H | THERMAL EXPANDABLE TONER DENSITY H% (%) |
|---|---|---|
| 0 | H0 | 0 |
| ⋮ | ⋮ | ⋮ |
| 40 | H80 | 80 |
| ⋮ | ⋮ | ⋮ |
| 50 | ⋮ | ⋮ |
| ⋮ | ⋮ | ⋮ |
| 70 | ⋮ | ⋮ |
| ⋮ | ⋮ | ⋮ |
| 100 | Hm | 100 |

FIG.3C

TABLE 2

| L * a * b * H% | | | | Y | M | C | K | H% |
|---|---|---|---|---|---|---|---|---|
| L*0 | a*0 | b*0 | H%0 | Y0 | M0 | C0 | K0 | H%0 |
| L*1 | a*1 | b*1 | H%1 | Y1 | M1 | C1 | K1 | H%1 |
| L*2 | a*2 | b*2 | H%2 | Y2 | M2 | C2 | K2 | H%2 |
| L*3 | a*3 | b*3 | H%3 | Y3 | M3 | C3 | K3 | H%3 |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| . | . | . | . | . | . | . | . | . |
| L*m | a*m | b*m | H%m | Ym | Mm | Cm | Km | H%m |

FIG.5

IMAGE FORMATION METHOD AND APPARATUS

BACKGROUND OF THE INVENTION

1. Field of the Invention

The present invention relates to an image forming method and apparatus which use an expandable material to form an embossed image, and more particularly to an image formation method and image formation apparatus which can easily and simply form a desired embossed image by converting height information on the embossed image to density information which indicates a density of a non-embossed image and controlling an amount of an expandable material which is transferred onto a recording medium according to the converted density information.

2. Description of the Related Art

Conventionally, an image formation apparatus such as a printer or a copy machine which adopts an electrophotographic method or an electrostatic recording method forms flatly an image such as characters, figures, photographs or the like in black and white or full color on a recording medium such as a recording sheet, and the formed image is visually recognized and used as a desired information conveying unit.

Meanwhile, it is demanded in recent years to provide a method which can convey to a third party not only visually flat information by an image formed on a recording medium but also a variety of information by addition of three-dimensional information based on shadows produced by vertical intervals of the image or the touch with fingers.

As a method to add three-dimensional information to the image, there is a method to form the image as a three-dimensional embossed image.

The method of forming an embossed image has been devised in various ways, and a variety of techniques have been proposed.

For example, as a method of producing a pamphlet or the like having an embossed image, there is a method to form an embossed image by printing an ultraviolet-curing type high-viscosity polymer ink into a raised form by a printing technique such as ordinary silk-screening and curing by irradiating ultraviolet rays to form an embossed image, but such a method cannot be easily used by an ordinary office or a public facility.

Japanese Patent Application Laid-Open Publication No. 52-28325 proposes a toner for electrophotography containing a dry expandable agent.

This toner for electrophotography containing a dry expandable agent is a toner which has a conventional toner and the dry expandable agent mixed in powder form and can be used to obtain an embossed image by forming an image and expanding the dry expandable agent by heating.

But, some powder mixture cannot have the toner and the expandable agent mixed uniformly and adequately, the expandable agent not having an adhesive power is often on the interface with paper, and an embossed image having an adequate fixing property cannot be obtained.

Japanese Patent Application Laid-Open Publication No. 7-061047 proposes an information input/output method for forming a projection image by using a toner containing a heat-sensitive expanding agent.

The toner used for the above method is produced by mixing and finely pulverizing a binder resin for a toner, a coloring agent and a heat-sensitive expanding agent. The pulverized toner has the heat-sensitive expanding agent revealed on its surface.

Therefore, the heat-sensitive expanding agent is exposed on the interface between paper and the toner. The adhesion between the toner and the paper is degraded in the same way as the above-described proposition, and the obtained image has a degraded fixing property.

Because the heat-sensitive expanding agent is exposed to the toner surface, the toner surface has a nonuniform electrostatic property. Therefore, the toner has a wide distribution of electrification, and when the toner is used under low-temperature and low-humidity environments or for a long period, the image has fogging or the like, and image quality is degraded.

Besides, because the used toner is produced by an ordinary kneading and pulverizing method, it is considered that the heat-sensitive expanding agent is mostly expanded by heating at the time of kneading and its effect is lost.

As a result, the expanding agent cannot expand sufficiently when thermally fixed only by an ordinary copy machine or the like. It is necessary to additionally pass the output image through an overheating device. It is insufficient in terms of simplicity and easiness.

Therefore, the present applicant has already proposed a novel image forming toner which can be used to easily form an embossed image by a common copy machine or a printer and an image formation apparatus using the above image forming toner (Japanese Patent Application Laid-Open Publication No. 2000-131875 and Japanese Patent Application Laid-Open Publication No. 2001-134006).

The image formation apparatus according to Japanese Patent Application Laid-Open Publication No. 2000-131875 is configured in such a way that the toner contains at least a binder resin and an expanding agent, the toner does not substantially have the expanding agent exposed to the toner surface, and the expanding agent contained in the toner is expanded by a fixing unit to form an embossed image on a recording medium. Thus, by using the toner containing the binder resin and the expanding agent, an embossed image can be formed on a recording medium.

The image formation apparatus according to Japanese Patent Application Laid-Open Publication No. 2001-134006 uses a toner which contains at least a binder resin and an expanding agent. To fix the toner image formed with the toner on a recording medium by a fixing unit, the expanding agent contained in the toner is expanded by the fixing unit to form the embossed image on the recording medium, and the fixed toner image has an image structure in which the expanding agent has at least two layers of expanded gas bubble. After the thermal fixing processing, an embossed image having adequate height and durability can be formed.

Japanese Patent Application Laid-Open Publication No. 2000-131875 and Japanese Patent Application Laid-Open Publication No. 2001-134006 are effective as techniques to realize an embossed image. But, they do not disclose a method of designating height information to actually give ups and downs to a print such as a map, graphics, a photograph image or the like and a method of forming an embossed image from image data.

Under the circumstances described above, the present invention provides an embossed image formation apparatus and embossed image information method which can easily form an embossed image desired by the user.

SUMMARY OF THE INVENTION

The present invention has been made in view of the above circumstances and an aspect of the present invention is an image formation method for forming an image containing an embossed portion of an expandable material on a recording medium, comprising: converting height information about an embossed image which is the image of the embossed portion to same density information as one used to indicate a density of a non-embossed image which is not raised; and controlling an amount of the expandable material formed on the recording medium according to the converted density information.

Another aspect of the present invention is an image formation method for forming an image containing an embossed portion of an expandable material on a recording medium, comprising: converting height information about an embossed image which is the image of the embossed portion to same density information as one used to indicate a density of a non-embossed image which is not raised; and sending the converted density information to an image formation apparatus which controls an amount of the expandable material formed on the recording medium according to the density information.

Still another aspect of the present invention is an image formation apparatus for forming an image containing an embossed portion of an expandable material on a recording medium, comprising: a conversion unit which converts height information about an embossed image which is the image of the embossed portion to same density information as one used to indicate a density of a non-embossed image which is not raised; and a control unit which controls an amount of the expandable material formed on the recording medium according to the density information converted by the conversion unit.

According to the present invention, it is possible to form an embossed image, whose height on a recording medium is controlled, by an ordinary electrophotographic type copy machine, a small printer or the like.

As used in the specification and claims herein, the word "embossed image" refers to an image having a three-dimensional appearance.

BRIEF DESCRIPTION OF THE DRAWINGS

Preferred embodiments of the present invention will be described in detail based on the following figures, wherein:

FIG. 3A to FIG. 3C are structure diagrams of Table 1, Table 1' and Table 1" showing corresponding relationships among height ratio T %, thermal expandable toner amount H and thermal expandable toner density H %;

FIG. 5 is a structure diagram of Table 2.

DESCRIPTION OF THE PREFERRED EMBODIMENTS

Embodiments of the present invention will be described with reference to the accompanying drawings.

Figure 1:
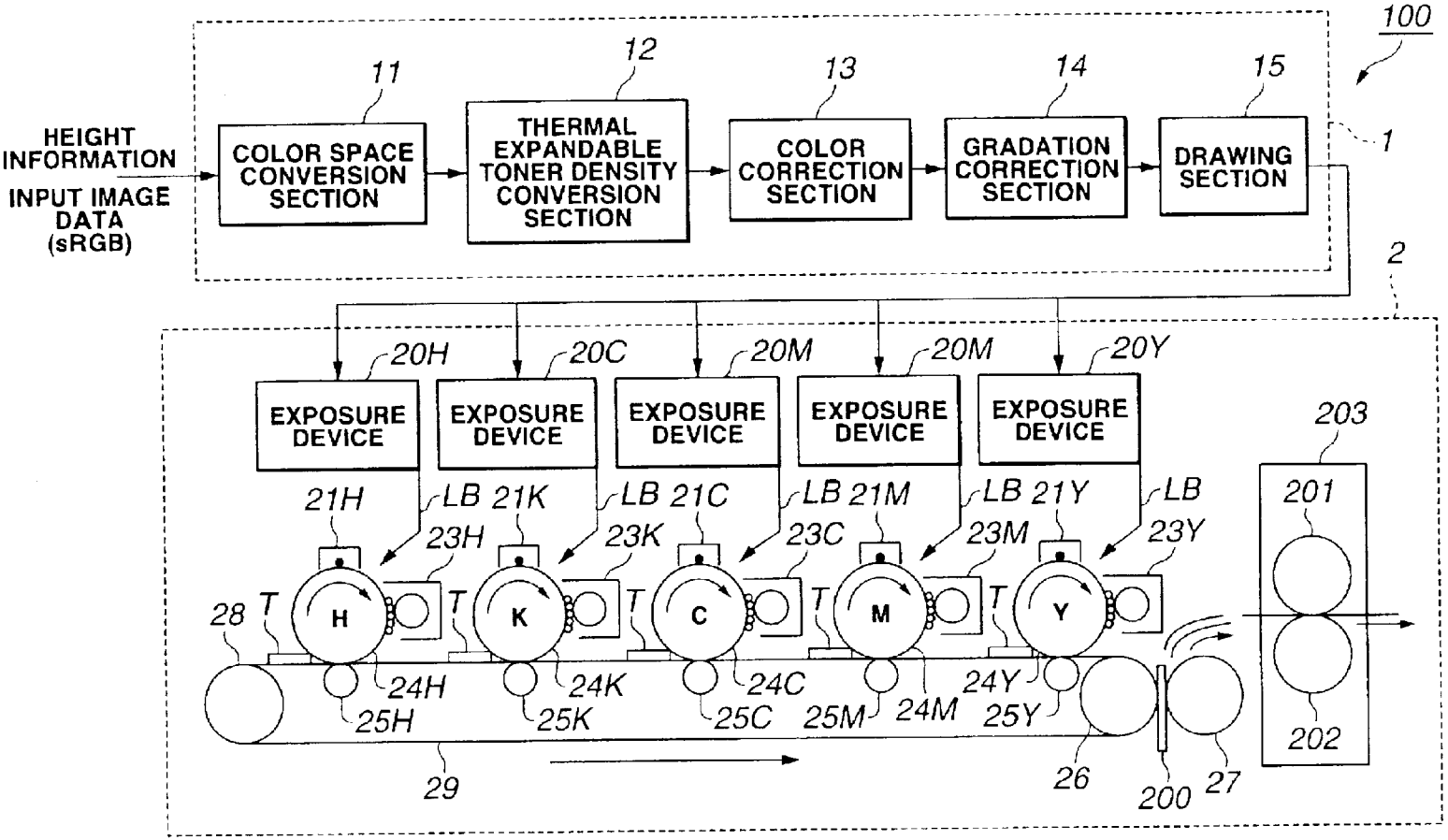
FIG. 1 is a block diagram showing a structure of the main components of an image formation apparatus according to the present invention.

FIG. 1 is a block diagram showing a structure of the main components of the image formation apparatus according to the present invention.

This image formation apparatus is used as, for example, a color printer of an electrophotographic type.

It is to be understood that FIG. 1 shows an example of embodiments of the present invention, and the invention is not limited to it.

As shown in FIG. 1, an image formation apparatus 100 according to the present invention is mainly comprised of an image processing section 1 and an image forming section 2.

The image processing section 1 has a color space conversion section 11 which performs gamma correction of image data (including, e.g., an sRGB image signal of red (R), green (G), blue (B) and a user-designated height information signal) input from an unshown personal computer or the like to convert into an independent color space which does not depend on a device, thermal expandable toner density conversion section 12 which sets an amount of a thermal expandable toner of the input image data according to the user-designated height information (e.g., brightness is designated when an image having a height of an embossed image controlled according to brightness of the input image data is formed), a color correction section 13 and a gradation correction section 14 which produce four original color material gradation data on yellow (Y), magenta (M), cyan (C) and black (K) (8 bits each) and expandable toner gradation data (expandable toner amount information) to show colors by a printer, and a drawing section 15 which produces image formation data for driving exposure devices 20Y to 20H of the image forming section 2 and outputs the image formation data to the image forming section 2.

The image forming section 2 has the exposure devices 20Y to 20H which control light exposure of photoconductors 24Y to 24H by laser beam LB according to the image formation data which is image-processed and transmitted by the image processing section 1, electrizing devices 21Y to 21H which previously change the surfaces of the photoconductors 24Y to 24H to a prescribed polarity (e.g., negative polarity), developing devices 23Y to 23H which develop latent images formed on the surfaces of the photoconductors 24Y to 24H with a toner to form toner images T, an intermediate transfer unit 29 which is disposed below the photoconductors 24Y to 24H and transfers the toner images T formed on the photoconductors 24Y to 24H, a fixing device 203 which fixes the toner images T of the intermediate transfer unit 29 onto a recording medium 200.

The exposure devices 20Y to 20H modulates an unshown semiconductor laser according to the original reproduction coloring material gradation data input from the image processing section 1 and emits the laser beam LB to the photoconductors 24Y to 24H to scan and expose them.

The photoconductors 24Y to 24H are driven to rotate in an arrow direction at a prescribed speed by an unshown drive unit.

The surfaces of the photoconductors 24Y to 24H are previously charged uniformly by corona electrizers of electrizing devices 21Y to 21H and exposed to and scanned by the laser beam LB according to the original reproduction coloring material gradation data to form electrostatic latent images.

When the developing devices 23Y to 23H are used for a full color machine, developers of yellow (Y), magenta (M), cyan (C), black (K) and white (H: thermal expandable toner) are introduced into them.

Here, all of the developers stored in the developing devices 23Y to 23H may be developers which mainly consist of the thermal expandable toner of the present invention or at least one or two or more colors may be provided by the developers which mainly consist of thermal expandable toner of the present invention.

According to the colors of an image to be formed, the toner images T of all or part of the five colors of yellow (Y), magenta (M), cyan (c), black (K) and white (H: thermal expandable toner) to be formed on the photoconductors 24Y to 24H are transferred onto the surfaces of the intermediate transfer unit 29 in a state sequentially multiplied by primary transfer rolls 25Y to 25H.

The toner image T which is formed by sequentially superimposing and transferring onto the intermediate transfer unit 29 is applied with a bias of an opposite polarity from a frictional electric charge of the toner by a secondary transfer roll 27 and, transferred onto the recording medium 200.

The intermediate transfer unit 29 has a drive roll 28 and a driven roll 26, and the driven roll 26 is disposed as a roll opposite to the secondary transfer roll 27.

The intermediate transfer unit 29 is supported to rotate in an arrow direction at the same moving speed as the peripheral speeds of the photoconductors 24Y to 24H.

The toner image T transferred onto the intermediate transfer unit 29 is transferred onto the recording medium 200 in prescribed timing.

The toner images T having the prescribed colors are collectively transferred from the intermediate transfer unit 29 onto the recording medium 200 by the driven roll 26 and the secondary transfer roll 27 as described above.

The toner images T collectively transferred onto the recording medium 200 are transported to the fixing device 203 and fixed onto the recording medium 200 by being heated and pressed by means of a heating roll 201 and a pressure roll 202 disposed in the fixing device 203.

In the area where the thermal expandable toner of the collectively transferred toner images T is transferred, the thermal expandable toner is thermally expanded by being heated by the fixing device 203 to form an embossed image.

The image formation apparatus 100 of the present invention controls an amount of the thermal expandable toner (H) according to the input image's height information designated by the user to form the embossed image whose height is controlled according to the designated height information.

Figure 2A:
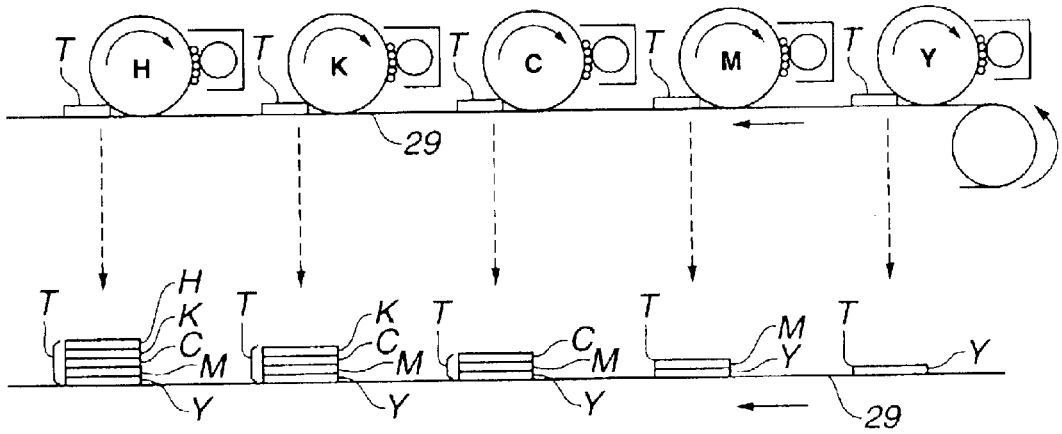
FIG. 2A to FIG. 2C are conceptual sectional views illustrating transferring and fixing processes by the image formation apparatus shown in FIG. 1 and a formed image.
Figure 2B:
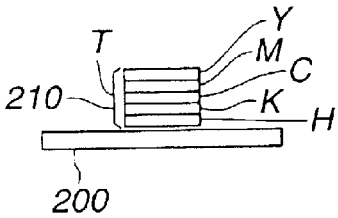
Figure 2C:
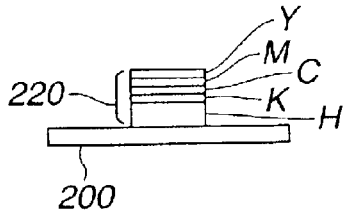

FIG. 2A to FIG. 2C are conceptual sectional diagrams for illustrating transferring and fixing processes by the image formation apparatus 100 and a method of forming the embossed image according to the present invention.

As shown in FIG. 2A, the toner images T of all or part of five colors of yellow (Y), magenta (M), cyan (C), black (K) and white (H: thermal expandable toner) to be formed on the photoconductors 24Y to 24H shown in FIG. 1 according to the colors of the image to be formed are transferred onto the intermediate transfer unit 29 in a state sequentially superimposed by the primary transfer rolls 25Y to 25H.

As shown in FIG. 2B, the toner images T sequentially superimposed and transferred onto the intermediate transfer unit 29 (see FIG. 2A) are collectively transferred onto the recording medium 200 (FIG. 2B, 210: unfixed color toner image) by applying a bias having an opposite polarity from a toner electric charge to the secondary transfer roll 27.

The unfixed color toner images T (FIG. 2B, 210: unfixed color toner image) collectively transferred onto the recording medium 200 are transported to the fixing device 203 and pressed and heated by the heating roll 201 and the pressure roll 202 disposed in the fixing device 203 and fixed onto the recording medium 200 (FIG. 2C, 220: fixed color toner image).

As shown in FIG. 2C, the fixed color toner image 220 formed by the image formation apparatus 100 of the present invention forms an embossed color image by thermal expansion of the toner image in the area where the thermal expandable toner (H) image is transferred.

Embodiment 1 according to the present invention converts the respective pixel areas of the input image into density information about the thermal expandable toner according to the height information (color brightness of image data) designated by the user and controls an amount of the thermal expandable toner according to the density information to form the embossed color image having the desired height and coloration on the recording medium.

As shown in FIG. 1, the image processing section 1 of the image formation apparatus 100 according to the present invention has the color space conversion section 11, the thermal expandable toner density conversion section 12, the color correction section 13, the gradation correction section 14 and the drawing section 15.

Image data (containing, e.g., an sRGB image signal of red (R), green (G) and blue (B) and a user-designated height information (color brightness) signal) input from an unshown personal computer or the like is input to the color space conversion section 11.

Generally, the color brightness is indicated by a value of L* in an L*a*b* color space which does not depend on the device.

Accordingly, the color space conversion section 11 performs gamma correction of the input image data (sRGB) signal, converts the converted RGB value to a value of an XYZ color space which is independent of the device and converts to a value of the L*a*b* color space (CIE1976).

Brightness of the input image data (sRGB) signal can be obtained by converting the input image data (sRGB) signal to a value of the L*a*b* color space and calculating a value of L*.

The conversion from the RGB value to the value of the XYZ color space can be determined by using, for example, the following conversion expressions.

$$X=0.4124\times R+0.3576\times G+0.1805\times B$$

$$Y=0.2126\times R+0.7152\times G+0.0722\times B$$

$$Z=0.0190\times R+0.1192\times G+0.9505\times B$$

The conversion from the value of the XYZ color space to the value of the L*a*b* color space can be determined by, for example, the following conversion expressions.

The value of L* is converted by using the following conversion expressions:

$$L^*=116x(Y/Yw)^{(1/3)}$$

when (Y/Yw)>=0.008856, and $$L^*=903.29\times(Y/Yw)$$

when (Y/Yw)<0.008856.

Values of a* and b* are converted by using the following conversion expressions.

$$a^*=500x(xx-yy)$$

$$b^*=200x(yy-zz)$$

In the above conversion expression of a* and b*, when (X/Xw)>=0.008856, it is $xx=(X/Xw)^{(1/3)}$;
when $(X/Xw)<0.008856$,
it is $xx=7.787xX/Xw+16/116$;
when $(Y/Yw)>=0.08856$,
it is $yy=(Y/Yw)^{(1/3)}$;
when $(Y/Yw)<0.008856$,
it is $yy=7.787xY/Yw+16/116$;
when $(Z/Zw)>=0.008856$,
it is $zz=(Z/Zw)^{(1/3)}$; and
When $(Z/Zw)<0.008856$,
it is $zz=7.787\times Z/Zw+16/116$.

In the above expressions, Xw, Yw and Zw indicate the respective values of white points in the XYZ color space.

By using the above conversion expressions, the signal of input image data (sRGB) can be converted to the value of the L*a*b* color space.

In the color space conversion section 11, the input image data is converted to the value of L*a*b* for each pixel area and input to the thermal expandable toner density conversion section 12 together with the converted value of L*a*b* and the converted height information (color brightness).

The thermal expandable toner density conversion section 12 calculates a height ratio T % of the brightness L* value of each pixel area of the input image data according to the L*a*b* values of the input image data converted by the color space conversion section 11 and the converted height information (color brightness).

The height ration T % here indicates the brightness L* (e.g., L* 1) value having the input image data on each pixel area converted to the L*a*b* color space in percentage (%) against a range (e.g., L*0 to L*n) of an actual value of brightness L* of the color in the L*a*b* color space.

For example, when it is assumed that the value of L* of each pixel area of the input image data is L*1 and a range of the actual value of the brightness L* in the L*a*b* color space is L*0 to L*n, the height ratio T % 1 (percentage) of the brightness L*1 value of the input image data is calculated by $T\ \%1=((L^*1-L^*0)/(L^*n-L^*0))\times 100$.

Table 1 in which the height ratio T %, the thermal expandable toner amount H and the thermal expandable toner density H % are corresponded with one another is stored in the thermal expandable toner density conversion section 12, and the input image data is converted to the value of the L*a*b* color space by the color space conversion section 11, and the thermal expandable toner amount H and the thermal expandable toner density H % corresponding to the height ratio T % of the converted L* value can be calculated from Table 1.

Here, the thermal expandable toner density indicates the same density value as that used to indicate the density of a non-embossed image which is not raised. This density is indicated according to an area gradation method on the recording medium.

When the thermal expandable toner is formed on the recording medium according to the density value, the density does not actually change but the height changes.

FIG. 3A to FIG. 3C are structure diagrams of Table 1, Table 1' and Table" which show corresponding relationships among the height ratio T %, the thermal expandable toner amount H and the thermal expandable toner density H %.

As shown in FIG. 3A, for example, when it is assumed that an input image data (sRGB) signal of each pixel area is converted to a value of the L*a*b* color space by the color space conversion section 11 and the height ratio T % of brightness L* of the input image data signal is calculated as "70"(%) from the converted L*a*b* values by the thermal expandable toner density conversion section 12, "70"(%) is searched in the left column of the value of T % in Table 1 to find the thermal expandable toner amount H of "H30" in the middle column and the thermal expandable toner density H % of "30"(%) in the right column corresponding to the T % value "70"(%).

Thus, the height ratio T % is calculated according to the color brightness from the input image data signal, and the thermal expandable toner density H % and the thermal expandable toner amount H corresponding to each of brightness can be calculated with ease.

For example, Table 1 can be previously produced by the following procedure.

First, input image data for output of a patch (test print) is prepared.

From this input image data for patch output, a patch is output while varying the thermal expandable toner amount H from 0 by a prescribed amount ΔH by using the image formation apparatus 100 according to the present invention, and height T of the patch-output embossed image is measured.

In a range that the patch-output embossed image can be adequately recognized and a fixing property is sufficient in practical use, a corresponding relationship between the thermal expandable toner amount H and the height T of the embossed image is graphed according to the measured result.

Figure 4:
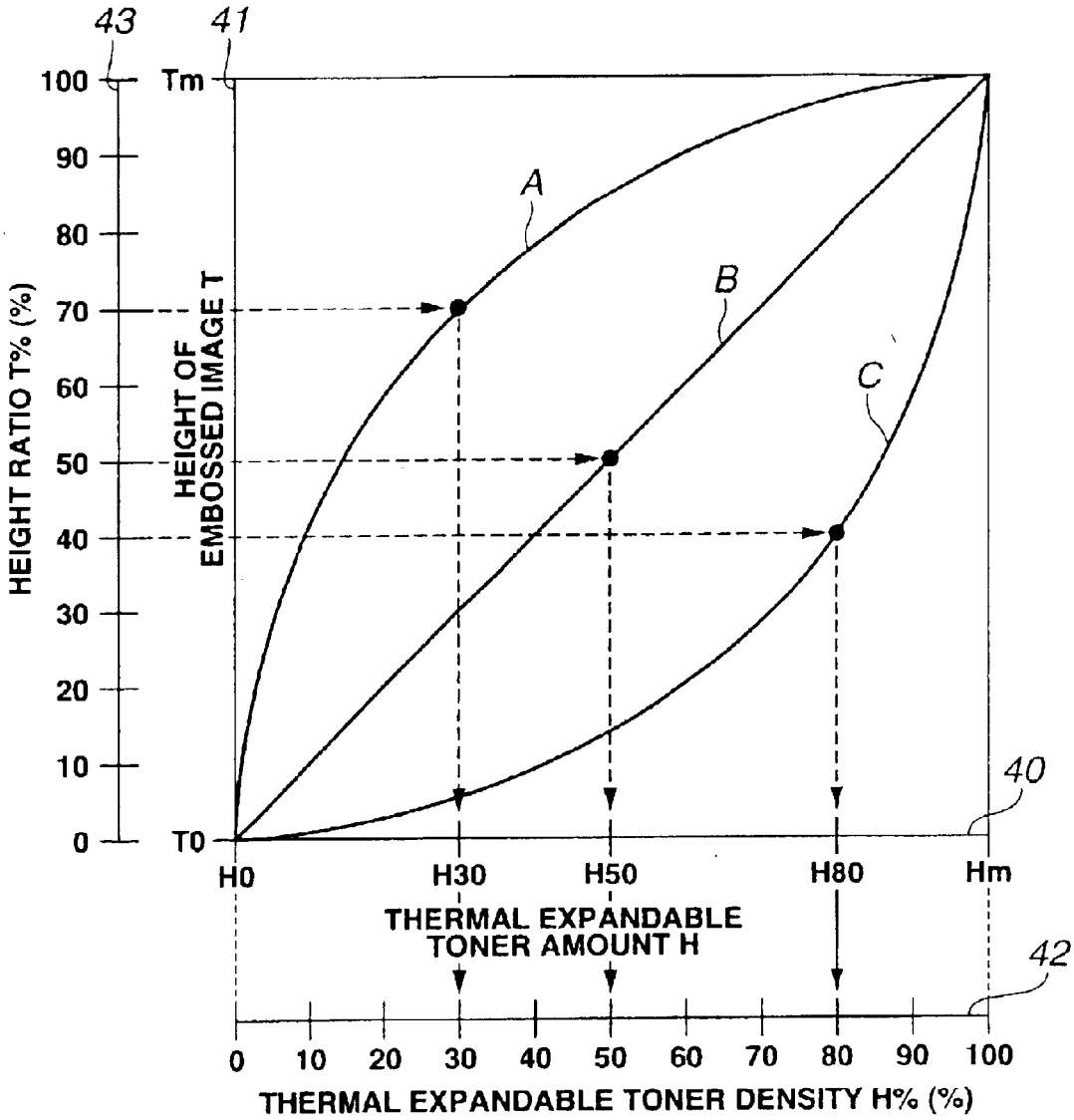
FIG. 4 is a graph showing a corresponding relationship among the height ratio T %, the thermal expandable toner amount H and the thermal expandable toner density H %.

As shown in FIG. 4, a characteristic graph A of the embossed image height T corresponding to the thermal expandable toner amount H is prepared by taking the thermal expandable toner amount H on horizontal axis 40 and the embossed image height T on vertical axis 41.

This characteristic graph A is prepared by plotting the value of the embossed image height T with respect to each thermal expandable toner amount H while changing the thermal expandable toner amount H from 0 by a prescribed amount ΔH and performing linear interpolation or the like.

The characteristic graph A has the embossed image height T as T0 when the thermal expandable toner amount H is 0 (H0), and the thermal expandable toner amount H as Hm when the embossed image height T is maximum (Tm) in a range that the patch-output embossed image is adequately recognizable and a fixing property is also adequate in practice.

It is assumed that the vertical axis 41 (embossed image height T) and the horizontal axis 40 (thermal expandable toner amount H) of the characteristic graph A prepared by the above-described procedure are 100% when the embossed image height T is maximum (Tm), the thermal expandable toner amount Hm at that time is 100%, H0 is 0% when the thermal expandable toner amount is 0, and the embossed image height T0 is 0% at that time. And, a graph with the addition of a vertical axis 43 (height ratio T %) and a horizontal axis 42 (thermal expandable toner density H %) having 0% to 100% graduated at regular intervals is prepared.

According to the above-described method, the corresponding relational graph of the thermal expandable toner amount H (horizontal axis 40) and the embossed image height T (vertical axis 41) can be converted to the corresponding relational graph of the height ratio T % (vertical axis 43) and the thermal expandable toner density H % (horizontal axis 42).

For example, it is assumed that the corresponding relationship among the height ratio T % of the embossed image formed on the recording medium 200, the thermal expandable toner amount H and the thermal expandable toner density H % is obtained as indicated by the graph A, graph B and graph C of FIG. 4 by the above-described procedure.

Then, according to the corresponding relationship of the graph A, when an image is to be formed with the height ratio T % of "70"(%), the thermal expandable toner density H % is "30"(%), and the thermal expandable toner amount H at that time is converted to "H30". Thus, the image having the target height can be obtained.

According to the corresponding relationship of the graph B, when an image is desired to be formed with the height ratio T % of "50"(%), the thermal expandable toner density H % is "50"(%), and the thermal expandable toner amount H at that time is converted to "H50". Thus, the image having the target height can be obtained.

According to the corresponding relationship of the graph C, when an image is desired to be formed with the height ratio T % of "40"(%), the thermal expandable toner density H % is "80"(%), and the thermal expandable toner amount H at that time is converted to "H80". Thus, a corresponding relationship to obtain the image with the target height can be obtained.

The tables prepared according to the characteristic graphs A, B and C which indicate the corresponding relationships among the height ratio T %, the thermal expandable toner amount H and the thermal expandable toner density H % are Table 1, Table 1' and Table" as shown in FIG. 3.

According to the above tables, the thermal expandable toner density H % and the thermal expandable toner amount H corresponding to the user-designated color brightness (height information) can be determined from the input image data.

The values of thermal expandable toner amount H and thermal expandable toner density H % calculated according to the brightness (L*) value of the input image data by the thermal expandable toner density conversion section 12 and the L*a*b* values are input to the color correction section 13.

The color correction section 13 produces a signal of YMCKH % from the thermal expandable toner amount H and the thermal expandable toner density H % value input from the thermal expandable toner density conversion section 12 and the L*a*b* values.

The color correction section 13 stores Table 2 which is used to calculate a color correction conversion coefficient to be used for color correction of the embossed color image.

FIG. 5 is a structure diagram of Table 2.

As shown in FIG. 5, Table 2 stores color correction conversion coefficients used to generate the signal of YMCKH % from the signal of L*a*b*.

Specifically, Table 2 is a table to correspond L*a*b* with YMCKH % (color correction conversion coefficient: coloration information) according to which, when a value in the left column of Table 2 is L*a*b*, a color correction conversion coefficient of a value of YMCKH % in the right column corresponding to the L*a*b* values is used to perform color correction, so that desired coloration of the embossed color image according to the expandable toner density H % formed at that time can be obtained.

In Table 2, H % values "H %0", "H %1", "H %2", . . . "H % m" are values of thermal expandable toner density H % calculated by the thermal expandable toner density conversion section 12.

In other words, the thermal expandable toner amount H and the thermal expandable toner density H % are calculated by the thermal expandable toner density conversion section 12 according brightness L* designated by the user from the input image data, and the YMCKH % value is determined from the calculated thermal expandable toner amount H and thermal expandable toner density H % and the L*a*b* values.

For example, Table 2 can be previously prepared according to the following procedure.

First, this image processing device 100 is used to previously vary the expandable toner density H % from 0% to 100% by a prescribed amount ΔH % so to output a CMYK signal set to the image forming section 2 and to perform patch output.

As shown in Table 1, Table 1' and Table" of FIG. 3, when the value of thermal expandable toner density H % is determined, the value of thermal expandable toner amount H is uniquely defined.

Therefore, when the thermal expandable toner density H % is varied from 0% to 100% by a prescribed amount Δ H %, the thermal expandable toner amount H is discharged according to the thermal expandable toner density H %.

Then, the output patch is measured for color to generate a device property transmission model which corresponds the L*a*b* value with the CMYKH % value.

An algorithm to prepare the device property transmission model includes various methods such as a neural network, a multiple regression method, Neugebauer theoretical formula and the like, and no particular method is designated.

Then, DLUT (LUT for three-dimensional color correction) indicating the correspondence between the L*a*b* value and the CMYKH % value is prepared.

To prepare the DLUT, a K value is determined from the L*a*b* value by a UCR (black generation/under color removal) processing corresponding to the expandable toner density H %, and the CMYK value is determined from the K value and the expandable toner density H %.

In other words, inverse mapping is performed with the K value and the H % value of the device property transmission model determined by the above-described patch color measurement stored.

When color correction is performed using a color correction conversion coefficient (YMCKH %) corresponding to the L*a*b* values from the device property transmission model produced by the above-described procedure, an embossed color image having the desired height and coloration can be produced by using the expandable toner density H % corresponding to brightness (L*) of the input image signal.

Such relationships are stored in Table 2.

The color correction section 13 generates signals of L*a*b* value and H % value from the values of the thermal expandable toner density H % and the L*a*b* values input from the thermal expandable toner density conversion section 12 and uses Table 2 to perform color correction by calculating a YMCKH % value in the right column corresponding to the L*a*b*H % value in the left column of Table 2.

Specifically, the L*a*b* values input from the thermal expandable toner density conversion section 12 are used as a first key and the value of thermal expandable toner density H % is used as a second key to retrieve the L*a*b*H % value in the left column of Table 2, and a conversion coefficient (YMCKH % value) for color correction in the right column corresponding to the L*a*b*H % value is read.

The read color correction conversion coefficient (YMCKH % value) and the L*a*b*H % value are calculated (e.g., multiplication) to perform color correction.

The signal (Y, M, C, K, H %) undergone the color correction by the color correction section 13 is subject to gradation correction by the gradation correction section 14, image formation data for driving the exposure devices 20Y to 20H of the image forming section 2 is produced by the drawing section 15, and the image formation data is output to the image forming section 2.

In the image forming section 2, the thermal expandable toner density H % is calculated according to brightness (L*) of the input image data input from the image processing section 1, the toner image is transferred onto the recording medium 200 by the above-described method according to the image data (Y, M, C, K, H %: gradation data) undergone the color correction, and the transferred toner image is thermally fixed to the recording medium 200 to form an embossed image.

Thus, in Embodiment 1, the expandable toner density H % is determined according to the brightness (L*) of the input image data (sRGB), and an embossed color image having desired height and coloration is formed.

The user-designated height information is determined to be brightness (L*) in Embodiment 1, but the brightness (L*) may be replaced with psychometric chroma coordinates (a*(red-green color)) or psychometric chroma coordinates (b* (yellow-blue color)).

The psychometric chroma coordinates (a*) indicate red as a positive number of the a* value becomes larger in the L*a*b* color space and green as a negative number becomes larger, and the psychometric chroma coordinates (b*) indicate yellow as a positive number of the b* value becomes larger in the L*a*b* color space and blue as a negative number becomes larger.

In other words, the expandable toner density H % may be determined according to coloration (a*) of the red-green color or coloration (b*) of the yellow-blue color of the input image data (sRGB) to form an embossed color image having desired height and coloration.

The above description is the same as in Embodiment 1 except that the value of brightness (L*) of the input image data (sRGB) is replaced with the value of (a*(red-green color)) or the value of (b*(yellow-blue color)).

Embodiment 2 according to the present invention determines the expandable toner density H % according to luminance (Y) the input image data (sRGB) to form an embossed color image having desired height and coloration.

In order to determine luminance (Y) of the input image data (sRGB), Embodiment 2 converts the input image data on each pixel area to a value of the XYZ color space independent of the device and determines the expandable toner density H % according to the value of luminance (Y) of the value of the converted XYZ color space to form an embossed color image having desired height and coloration.

Embodiment 2 is the same as Embodiment 1 except that the signal of the input image data (sRGB) is converted to the XYZ value of the XYZ color space independent of the device and the height ratio T % of Y value (luminance) of the converted XYZ value is calculated. Therefore, for convenience's sake of explanation, the procedure that the input image data (sRGB) is converted to the XYZ value of the XYZ color space and the height ratio T % of Y value (luminance) of the converted XYZ value is calculated will be described with reference to FIG. 1.

The input image data (sRGB) on each pixel input from an unshown personal computer or the like is converted to the value of the XYZ color space by the color space conversion section 11, and the converted XYZ value and the height information (luminance) on the embossed image are input to the thermal expandable toner density conversion section 12.

In the thermal expandable toner density conversion section 12, a luminance (Y) value of the input image data on each pixel area to a range (e.g., Y0 to Yn) of the value which can be actually possessed by the height information (luminance) about the embossed image is calculated in percentage (height ratio T %) according to the value of XYZ of the input image data converted by the color space conversion section 11 and the height information (luminance Y) about the embossed image.

For example, when it is assumed that the value of Y is Y1 in a range of Y0 to Yn of the value which can actually be possessed by the height information (luminance Y) about the embossed image, the height ratio T % 1 of luminance Y can be calculated as follows.

$$T$$

$$132\ ((Y1-Y0)/(Yn-Y0))\times 100$$

The thermal expandable toner density conversion section 12 stores, for example, Table 1 as shown in FIG. 3A which corresponds the height ratio T % with the thermal expandable toner density H %. And, the thermal expandable toner density H % corresponding to the height ratio T % of the luminance Y value calculated by Table 1 is calculated.

When the height ratio T % of luminance Y is calculated, the subsequent processing is the same processing as in Embodiment 1 and determines the thermal expandable toner density H % according to luminance (Y) of the input image data (sRGB), and an embossed color image having desired height and coloration can be formed.

Embodiment 3 according to the present invention determines the expandable toner density H % according to color difference of the input image data (sRGB) to form an embossed color image having desired height and coloration. Generally, color difference ΔE* indicates a difference of two colors quantitatively and can be indicated by a distance between two points in a uniform color space.

Embodiment 3 is the same as Embodiment 1 except that in the thermal expandable toner density conversion section 12 of Embodiment 1, the value of color difference ΔE* is calculated from a white point of the input image data, and the height ratio T % of the calculated color difference ΔE* value is determined.

A procedure until the color difference ΔE* from the white point of the input image data (sRGB) and the height ratio T % of the color difference ΔE* are calculated will be described with reference to FIG. 1.

The input image data (sRGB) on each pixel input from an unshown personal computer is converted to the value of the L*a*b* color space by the color space conversion section 11, and the converted L*a*b* values and the height information (color difference) about the embossed image are input to the thermal expandable toner density conversion section 12.

The thermal expandable toner density conversion section 12 calculates the color difference ΔE* (e.g., color difference from the values of white points L*=95, a*=0, b*=0) of the input image data according to the value of L*a*b* of the input image data converted by the color space conversion section 11 and the height information (color difference) about the embossed image.

The color difference ΔE* can be determined from the following expression. Color difference $\Delta E^*=((95-L^*)^2+(0-a^*)^2+(0-b^*)^2)^{1/2}$ The height ratio T % (percentage (%)) of the color difference ΔE* value of the input image to a range (e.g., ΔE*0 to ΔE*n) of the value which can actually be possessed by the height information (color difference) about the embossed image is calculated from the value of color difference ΔE* of the input image data calculated by the above expression.

For example, when it is assumed that color difference ΔE* of the input image data is calculated as ΔE*1 by the thermal expandable toner density conversion section 12 and a range of the value which is actually possessed by the height information (color difference) about the embossed image is ΔE*0 to ΔE*n, the height ratio T %1 (percentage (%)) of the color difference ΔE*1 value can be calculated as follows.

$$T1=((\Delta E^*1-\Delta E^*0)/(\Delta E^*n-\Delta E^*0))\times 100$$

The thermal expandable toner density conversion section 12 stores, for example, Table 1 as shown in FIG. 3A which corresponds the height ratio T % with the thermal expandable toner density H %. And, the thermal expandable toner density H % corresponding to the height ratio T % of the color difference ΔE*1 value calculated by Table 1 can be calculated.

When the height ratio T % of the color difference ΔE* value of the input image data is calculated, the subsequent processing is the same as Embodiment 1 and performed to determine the thermal expandable toner density H % according to the color difference ΔE* of the input image data (sRGB) to form an embossed color image having desired height and coloration.

Embodiment 4 according to the present invention determines the expandable toner density H % according to chroma (C*) of the input image data (sRGB) to form an embossed color image having desired height and coloration.

The chroma (C*) can be indicated by, for example, distance (chroma C*)$=((0-a^*)^2+(0-b^*)^2)^{1/2}=(a^{*2}+b^{*2})^{1/2}$ from origin points a*=0, on an a*b* plane excepting the value of L* of the L*a*b* color space to the a* value and b* value of the input image data (sRGB).

Embodiment 4 is the same as Embodiment 3 except that the color difference ΔE* value of the input image data (sRGB) of Embodiment 3 is replaced with a chroma C* value and the chroma C* is calculated by the above conversion expression. Therefore, its description is omitted.

Embodiment 5 according to the present invention determines the expandable toner density H % according to gray scale GS of the input image data (sRGB) to form an embossed color image having desired height and coloration.

Generally, the gray scale GS changes brightness of the image for each gradation by using white and gray of the input image data (sRGB).

Embodiment 5 is the same as Embodiment 1 except that the signal of the input image data (sRGB) is converted to gray scale GS and the height ratio T % of the value of the converted gray scale GS is calculated.

The procedure to convert from the input image data (sRGB) to the gray scale GS and to calculate the height ratio T % of the value of the converted gray scale GS will be described with reference to FIG. 1.

The input image data (sRGB) on each pixel input from an unshown personal computer or the like has the value of gamma-corrected RGB and the height information (gray scale) about the embossed image input to the thermal expandable toner density conversion section 12.

The thermal expandable toner density conversion section 12 converts the value of RGB of the input image data which is converted by the color space conversion section 11 to the value of gray scale GS by the following conversion expression:

$$GS=0.3\times R+0.59\times G+0.11\times B$$

R, G and B in the conversion expression of the gray scale GS indicate the values of R (red), G (green) and B (blue) having the input image data (sRGB) signal gamma-corrected.

When it is assumed in the thermal expandable toner density conversion section 12 that the value of the gray scale GS of the input image data is GS1 and a range of the value which can actually be possessed by height information (gray scale) about the embossed image is, for example, GS0 to GSn, the height ratio T % (percentage (%)) of the value of gray scale GS of the input image data can be calculated as follows.

$$T1=((GS1-GS0)/(GSn-GS0))\times 100$$

The thermal expandable toner density conversion section 12 stores Table 1 as shown in, for example, FIG. 3A which corresponds the height ratio T % with the thermal expandable toner density H %. Therefore, the thermal expandable toner density H1% corresponding to the height ratio T % of the gray scale GS value calculated using Table 1 can be calculated.

When the height ratio T % of the gray scale GS is calculated, the subsequent processing is the same as in Embodiment 1 and can be performed to determine the expandable toner density H % according to the gray scale of the input image data (sRGB) to form an embossed color image having desired height and coloration.

Embodiment 6 according to the present invention designates whether the embossed image is formed or the embossed image is not formed from the input image data signal as the height information designated by the user and forms an embossed image or an ordinary image (ordinary color print image which is not embossed) according to the designated information.

For example, when the user designates the formation of an embossed image as the height information, Embodiment 6 sets the thermal expandable toner density H % to, for example, a maximum amount (100%), and when the user designates no formation of an embossed image as the height information, and the height information is binarized to form an image by setting the thermal expandable toner density H % to 0%.

Embodiment 6 is the same as Embodiment 1 except that, when the user designates the formation of an embossed image in the thermal expandable toner density conversion section 12 in Embodiment 1 of FIG. 1, the thermal expandable toner density H % is set to 100% according to the input image data signal and, when the user designates no formation of an embossed image, the thermal expandable toner density H % is set to 0% according to the input image data signal.

As another embodiment, it may be configured that the user-designated height information designates only a density of the input image data signal, a space frequency of the input image data signal and an edge portion of the input image data signal as an object of the input image data signal and a YMCK total sum signal, the thermal expandable toner density H % is set according to the designated height information to form an embossed color image having desired height and coloration.

In the embodiments described above, the thermal expandable toner was used as an expandable material for description but any material such as ink used for ink jet having expandability may be used.

What is claimed is:

1. An image formation method for forming an image containing an embossed portion of an expandable material on a recording medium, comprising:

converting height information about an embossed image which is the image of the embossed portion to density information used to indicate a density of a non-embossed image which is not raised; and controlling an amount of the expandable material formed on the recording medium according to the converted density information.

2. The image formation method according to claim 1, wherein the height information is a binary value indicating whether the image is raised or not.

3. The image formation method according to claim 1, wherein the height information is converted to the density information by a host apparatus, and the amount of the expandable material is controlled by an image formation apparatus.

4. The image formation method according to claim 1, wherein the height information is set according to brightness information about the image.

5. The image formation method according to claim 1, wherein the height information is set according to psychometric chroma coordinates a*, green-red color, of the image.

6. The image formation method according to claim 1, wherein the height information is set according to psychometric chroma coordinates b*, blue-yellow color, of the image.

7. The image formation method according to claim 1, wherein the height information is set according to luminance information about the image.

8. The image formation method according to claim 1, wherein the height information is set according to a color difference signal of the image.

9. The image formation method according to claim 1, wherein the height information is set according to chroma information about the image.

10. The image formation method according to claim 1, wherein the height information is set according to gray scale information about the image.

11. The image formation method according to claim 1, wherein the height information is set according to density information about the image.

12. The image formation method according to claim 1, wherein the height information is set according to color space frequency information about the image.

13. The image formation method according to claim 1, wherein the height information is set according to an edge portion of the image.

14. The image formation method according to claim 1, wherein the height information is set according to an image object of the image.

15. The image formation method according to claim 1, wherein the height information is set according to YMCK total sum of the image.

16. An image formation method for forming an image containing an embossed portion of an expandable material on a recording medium, comprising:

converting height information about an embossed image which is the image of the embossed portion to density information used to indicate a density of a non-embossed image which is not raised; and sending the converted density information to an image formation apparatus which controls an amount of the expandable material formed on the recording medium according to the density information.

17. An image formation apparatus for forming an image containing an embossed portion of an expandable material on a recording medium, comprising:

a conversion unit which converts height information about an embossed image which is the image of the embossed portion to density information used to indicate a density of a non-embossed image which is not raised; and a control unit which controls an amount of the expandable material formed on the recording medium according to the density information converted by the conversion unit.

* * * * *